US007402060B1

(12) United States Patent
Buzil et al.

(10) Patent No.: US 7,402,060 B1
(45) Date of Patent: Jul. 22, 2008

(54) POWER SUPPLY DEVICES WITH ILLUMINATED RECEPTACLES

(75) Inventors: Elliot Buzil, East Brunswick, NJ (US); Andrew Hung, East Brunswick, NJ (US); Ken Ku, East Brunswick, NJ (US)

(73) Assignee: Trans USA Products, Inc., Highstown, NJ (US)

( * ) Notice: Subject to any disclaimer, the term of this patent is extended or adjusted under 35 U.S.C. 154(b) by 0 days.

(21) Appl. No.: 11/650,864

(22) Filed: Jan. 8, 2007

(51) Int. Cl.
*H01R 4/60* (2006.01)

(52) U.S. Cl. ..... 439/214; 362/95; 439/490

(58) Field of Classification Search ..... 439/490, 439/214; 362/95
See application file for complete search history.

(56) References Cited

U.S. PATENT DOCUMENTS

| | | | | |
|---|---|---|---|---|
| 4,000,405 | A * | 12/1976 | Horwinski | 362/95 |
| 4,617,613 | A | 10/1986 | Rice | |
| 5,589,718 | A | 12/1996 | Lee | |
| 5,742,466 | A | 4/1998 | Kram | |
| 5,962,932 | A | 10/1999 | Matlo et al. | |
| 6,089,893 | A * | 7/2000 | Yu et al. | 439/225 |
| 6,273,587 | B1 | 8/2001 | Demshki | |
| 7,011,422 | B2 | 3/2006 | Robertson et al. | |
| 7,121,707 | B2 | 10/2006 | Currie et al. | |
| 2006/0039136 | A1 | 2/2006 | Probasco et al. | |
| 2006/0258226 | A1 | 11/2006 | Milan | |
| 2006/0278794 | A1 | 12/2006 | Rast | |

OTHER PUBLICATIONS

Monster Cable: Outlets To Go Power Strip—4 Outlets, <http://www.monstercable.com/productPage.asp?pin=3842>, retrieved from the internet Jan. 8, 2007, 2 pages.

Monster Cable: Home Theater PowerCenter™ HTS 850 with Clean Power™ Stage 1 v.2.0, <http://www.monstercable.com/productPage.asp?pin=1220>, retrieved from the Internet Jan. 8, 2007, 2 pages.

* cited by examiner

*Primary Examiner*—Javaid Nasri
(74) *Attorney, Agent, or Firm*—Lerner, David, Littenberg, Krumholz & Mentlik, LLP

(57) ABSTRACT

The present invention provides power supply devices having illuminated receptacles. Some or all of the receptacles are encircled or otherwise circumscribed by a lighting member. The lighting member may be a continuous strip of material, such as an electroluminescent laminate. The lighting member may illuminate the receptacles regardless of whether the receptacles themselves are currently powered. Thus, although the power supply device is in a no or low light environment, or when the device is plugged in but is turned off, a user may easily identify where the receptacles are, which ones are available, and which equipment is plugged into which receptacles. The lighting member may be color coded according to a surge protection rating for the power supply device. In this case, the user can immediately identify which power supply devices have a given surge protection, and can therefore distinguish among different power supply devices having similar physical configurations.

18 Claims, 8 Drawing Sheets

116
124
A
A
B
B 122
120

A-A
124

B-B
114
118a
118b $100_1$ $100_2$

200

300

300

POWER SUPPLY DEVICES WITH ILLUMINATED RECEPTACLES

BACKGROUND OF THE INVENTION

The present invention relates to power supply devices, including power strips, power taps, surge protection devices and the like that include a built-in light source to illuminate receptacles or plugs for the user.

Power supply devices such as power strips, power taps and surge protectors are used in many different environments for a wide variety of applications. For instance, a power strip in a home theater can supply power to stereo equipment, televisions and game systems. In an office the same power strip may be used to power a desktop or laptop computer, printers and scanners, a desk lamp, etc. A power tap may be plugged into a wall outlet to provide two or more additional outlets into which electronic equipment may be plugged. A surge protection device, whether stand alone or in combination with a power strip or power tap, may be placed between the wall outlet and the user equipment to provide additional protection to electronic equipment.

Such power supply devices may include a power on indicator in the form of an incandescent light or LED, which is illuminated when the device is turned on. The power on indicator may be included in the on/off switch, or may be separately located on the power supply device. Similarly, a surge protection indicator may be lit to indicate that a surge protection device is operating properly.

During use the power supply device may be partly or fully hidden behind furniture, a bookcase, or the electronic equipment to which it is supplying power. Hiding the device may be a conscious aesthetic decision by the user, or may be necessitated by the layout of the room or of the electronic equipment. In either case, the power supply device is often situated in a low light or no light location. Here, even though the device may have a power on indicator or surge protection indicator, such lights may not provide adequate lighting of the power supply device. In particular, these lights do not illuminate some or all of the receptacles on the power supply device. This can be highly problematic, especially in the situation where the user needs to add a component to a power strip, power tap or surge protector, or is unplugging a component from the device. Without adequate lighting, the user may not easily locate an available receptacle, or may confuse the plugs of different components and accidentally unplug the wrong one.

In the past, LEDs have been added to the corners of a power strip so that they light when the power strip is plugged in and turned on. However, such a configuration does not provide adequate illumination to individual receptacles or to the receptacles as a whole, and therefore does not overcome the aforementioned problems. Therefore, a need exists for enhanced power supply devices to address these and other problems.

SUMMARY OF THE INVENTION

In accordance with one embodiment of the present invention, a power supply device is provided. The power supply device comprises a housing member, a power connector, first and second power plates, a ground plate and a lighting member. The housing member has a side including an on/off switch and a plurality of receptacles adapted for electrical connection to external electronic equipment. The power connector is operable to electrically couple to a power source. The power connector has a hot lead, a neutral lead and a ground lead. The first power plate is electrically coupled to the hot lead of the power connector and operable to provide a hot connection to the plurality of receptacles. The second power plate is electrically coupled to the neutral lead of the power connector and is operable to provide a neutral connection to the plurality of receptacles. The ground plate is electrically coupled to the ground lead and is operable to provide a ground connection to the plurality of receptacles. The lighting member is disposed along the side of the housing member and circumscribes at least one of the plurality of receptacles. The lighting member is electrically coupled to the hot and neutral leads of the power connector, wherein the lighting member is operable to illumination the at least one receptacle.

In one alternative, the lighting member includes a first lead directly electrically connected to the hot lead, and a second lead directly electrically connected to the neutral lead so that the lighting member is illuminating while the power connector is electrically coupled to the power source.

In another alternative, the lighting member includes an illumination portion of an electroluminescent material. In one example, the electroluminescent material is a single continuous sheet of material. In another example, the lighting member further comprises a cover portion on the side of the housing. Here, the cover portion overlays the electroluminescent material. In a further example, the power supply device further includes a surge protection device electrically coupled to the first and second power plates. In this case, at least one of the electroluminescent material and the cover is selected to have a color identifying a surge protection rating associated with the power supply.

In a further alternative, the lighting member completely circumscribes all of the receptacles. In another alternative, the lighting member substantially encircles selected ones of the receptacles. In yet another alternative, the power supply is preferably a power strip and the power connector preferably includes cabling for electrically coupling to the power source. In another alternative, the power supply is preferably a power tap.

In accordance with another embodiment of the present invention, a power supply device is provided. The power supply device includes a housing member, a power connector, first and second power plates, a ground plate, and a surge protection device. The housing member has a side including an on/off switch and a plurality of receptacles adapted for electrical connection to external electronic equipment. The power connector is operable to electrically couple to a power source. The power connector has a hot lead, a neutral lead and a ground lead. The first power plate is electrically coupled to the hot lead of the power connector and is operable to provide a hot connection to the plurality of receptacles. The second power plate is electrically coupled to the neutral lead of the power connector and is operable to provide a neutral connection to the plurality of receptacles. The ground plate is electrically coupled to the ground lead and is operable to provide a ground connection to the plurality of receptacles. The surge protection device is electrically coupled to the first and second power plates and has a light means for identifying a surge protection rating of the surge protection device. Preferably the light means provides a color identification associated with the surge protection rating for distinguishing from similar power supply devices having different surge protection ratings.

In accordance with a further embodiment of the present invention, a power supply device comprises a housing member, a power connector, first and second power plates, and a means for lighting. The housing member including an on/off switch and a plurality of receptacles adapted for electrical connection to external electronic equipment. The power connector is operable to electrically couple to a power source. The power connector has a hot lead and a neutral lead. The first power plate is electrically coupled to the hot lead of the power connector and is operable to provide a hot connection to the plurality of receptacles. The second power plate is electrically coupled to the neutral lead of the power connector and is operable to provide a neutral connection to the plurality of receptacles. The lighting means circumscribes the plurality of receptacles, wherein the lighting means is operable to illuminate all of the receptacles.

In one alternative, the lighting means completely circumscribes all of the receptacles. In another alternative, the lighting means substantially encircles selected ones of the receptacles.

In a further alternative, the lighting means comprises an electroluminescent laminate having a first lead electrically coupled to the hot lead and a second lead electrically coupled to the neutral lead. In this case, the first and second leads may be electrically connected so that the electroluminescent laminate continuously illuminates while the power connector is electrically coupled to the power source. Optionally, the power supply may further comprise a switch connected to the first and second leads so that a user may manually turn illumination of the electroluminescent laminate on or off.

In a further alternative, the lighting means provides a color identification associated with a surge protection rating of the power supply. In yet another alternative, the housing member is preferably a rack mountable housing and includes a pair of flanges for mounting the power supply to an electronic equipment rack.

DETAILED DESCRIPTION

The aspects, features and advantages of the present invention will be appreciated when considered with reference to the following description of preferred embodiments and accompanying figures. In describing the preferred embodiments of the invention illustrated in the figures, specific terminology will be used for the sake of clarity. However, the invention is not intended to be limited to the specific terms so selected, and it is to be understood that each term selected includes all technical equivalents that operate in a similar manner to accomplish a similar purpose.

Figure 1A:
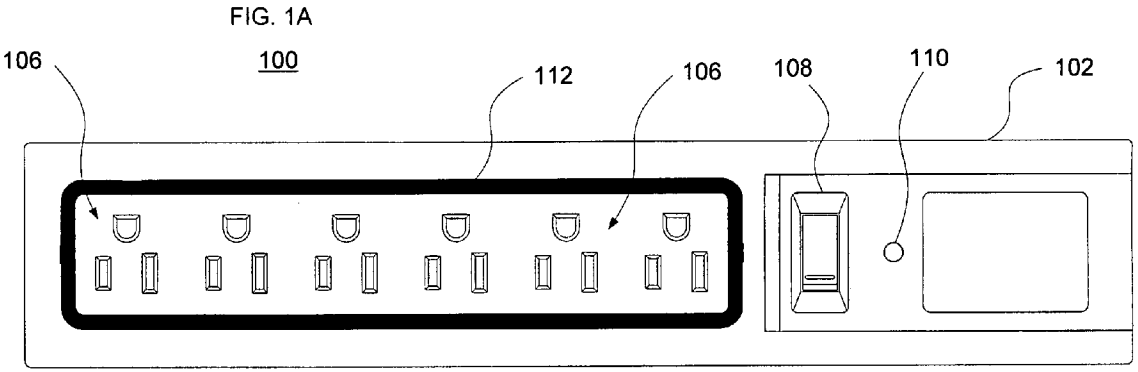
FIGS. 1A-D illustrate a power supply device in accordance with aspects of the present invention.
Figure 1B:
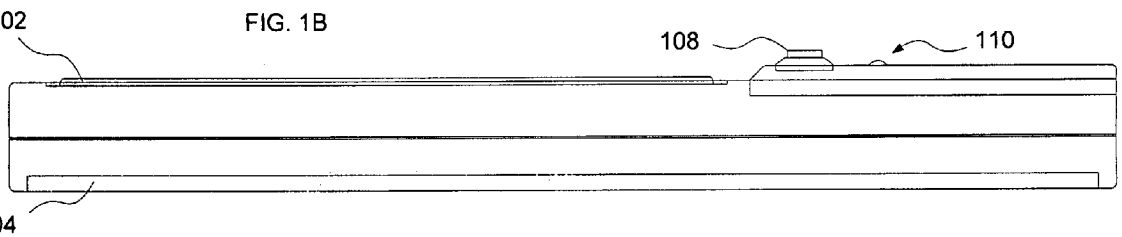
Figure 1D:
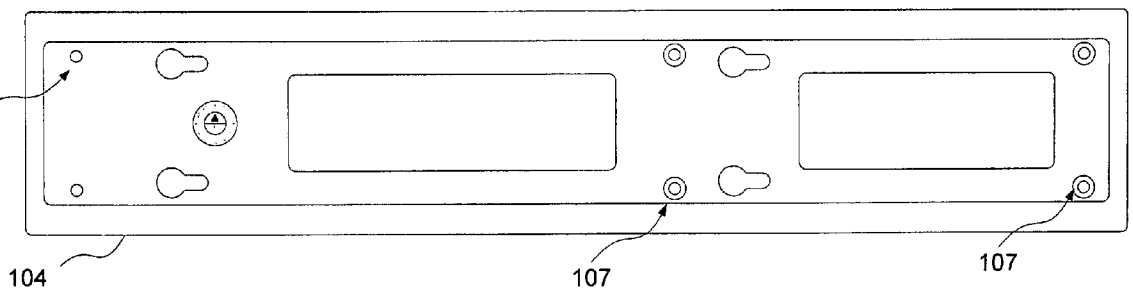
Figure 1C:
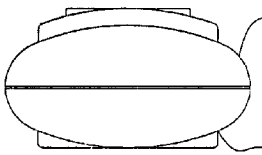

FIGS. 1A-D present a power supply device such as a power strip 100. Specifically, FIG. 1A is a top view of the power strip 100, FIG. 1B is a side view, FIG. 1C is an end view and FIG. 1D is a bottom view. As seen in the side view of FIG. 1B and the end view of FIG. 1C, the power strip 100 preferably includes an upper housing 102 and a lower housing 104. The upper housing 102 and the lower housing 104 may be secured together by screws or other fasteners (not shown). The fasteners may mount through one or more openings 107 in the lower housing, as shown in FIG. 1D.

The top view of FIG. 1A illustrates the power strip 100 as having six grounded receptacles 106. While six receptacles 106 are shown, it should be understood that the power strip 100 may include any number of receptacles 106, e.g., 2, 4, 5, 6, 10. The power strip 100 also preferably includes one or both of an on/off switch 108 and a surge protection indicator 110. The on/off switch 108 may be, for instance, a rocker-type switch, although other types of switches may be used, such as a push button switch, dial switch, etc. The on/off switch 108 may include a light source (not shown) that illuminates when the switch is in the "on" position, i.e., when the power strip 100 is electrically coupled to a power supply and the receptacles 106 can provide electricity to a connected user device. The surge protection indicator 110 is desirably illuminated while surge protection is active.

Also shown in FIG. 1A is a lighting member 112, which is shown circumscribing the receptacles 106. While the lighting member 112 may comprise a number of discrete light sources such as LEDs or incandescent bulbs, the lighting member 112 is most preferably a unitary or continuous lighting member. This gives optimal illumination of the receptacles 106 that it surrounds. Thus, unlike prior attempts at lighting a power strip, the present invention can provide substantially uniform illumination of the receptacles.

Figures 2A, 2B, 2C, 2D:
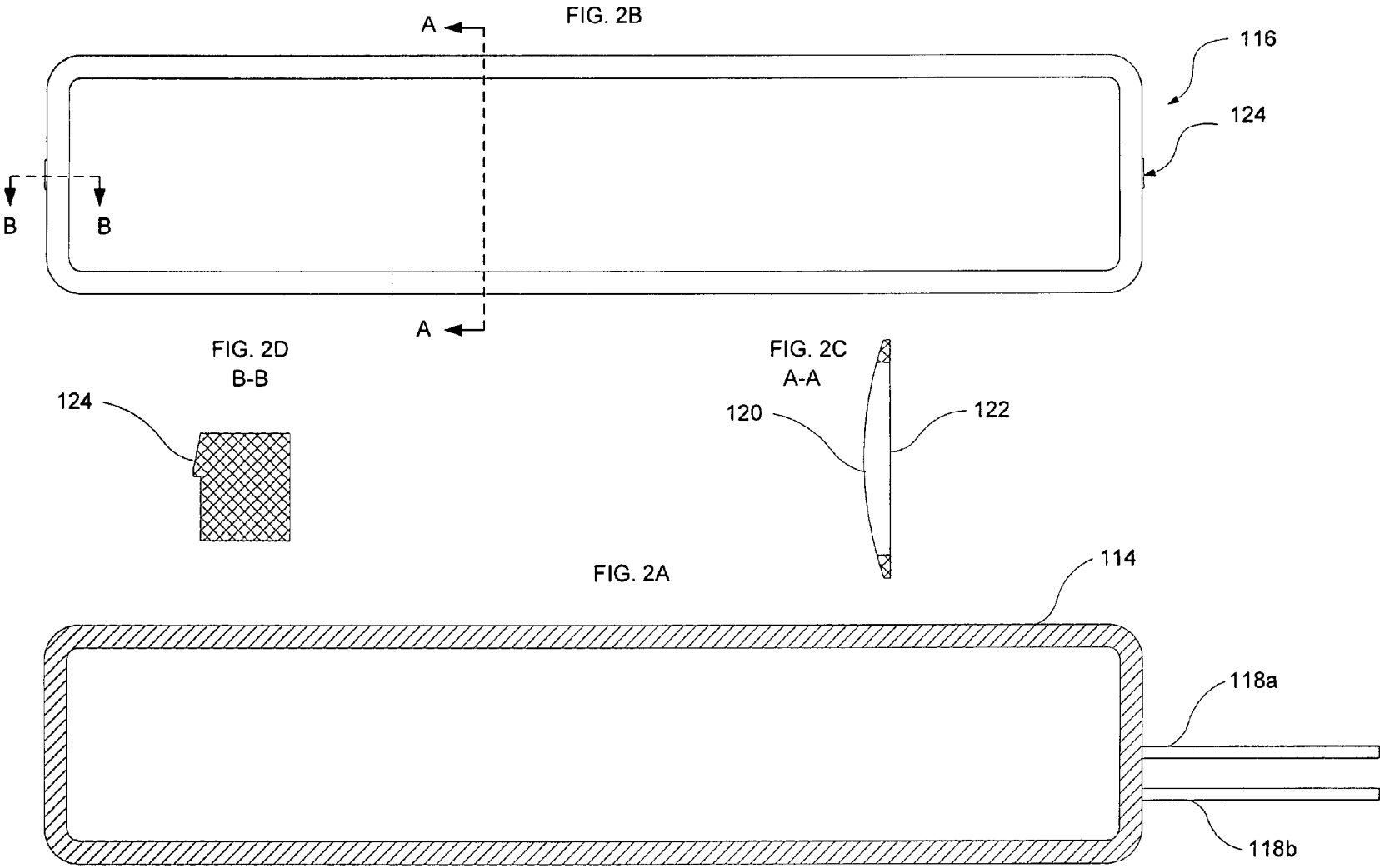
FIG. 2A-D illustrate an illumination portion of the power supply device of FIGS. 1A-D.

The continuous lighting member 112 preferably includes an electroluminescent material that provides a constant light about one or more of the receptacles 106. As shown in FIG. 1A, the member 112 preferably circumscribes all of the receptacles 106. FIGS. 2A-D illustrate the continuous lighting member 112 in detail. The member 112 preferably comprises an illumination portion 114 and a cover portion 116, which are shown in FIGS. 2A and 2B, respectively. As indicated above, the illumination portion 114 is desirably an electroluminescent material. Such material is particularly suitable for a number of reasons, including its low weight, it can be made in thin laminates, it bends easily and can be conformed to many different shapes, and it consumes very little power as compared to other light sources.

By way of example only, the electroluminescent material may have a thickness on the order 0.1 mm to 0.75 mm thick, for instance between about 0.25 mm and 0.5 mm. The exact thickness is not critical. Using an electroluminescent material for the illumination portion 114 is particularly advantageous, as the material may be cut or otherwise formed into nearly any shape or configuration desired. Thus, as seen in FIG. 2A, the illumination portion 114 has a generally open rectangular shape, and is preferably formed of a continuous sheet of electroluminescent material. The illumination portion 114 of electroluminescent material preferably includes a pair of leads 118*a* and 118*b*, which are desirably electrically wired so that the illumination portion 114 emits light so long as power is supplied to the power strip 100.

The cover portion 116 is preferably configured to substantially or completely overlay the illumination portion 114, exclusive of the leads 118*a,b*. As shown in the sectional view of FIG. 2C along the A-A line of FIG. 2B, exterior surface 120 may be rounded, while interior surface 122 may be substantially flat. FIG. 2D illustrates another sectional view of the cover portion 116 along the B-B line of FIG. 2B. Here, it can be seen that the cover portion 116 may include a lip 124 along a portion of the edge thereof.

The continuous lighting member 112 is especially beneficial in situations where the power strip 100 is placed in a low light or no light area, such as behind a couch, within a home theater entertainment unit, or hidden behind a large screen television. In such situations, the receptacles 106 are clearly illuminated by the continuous lighting member 112, enabling a user to readily find the receptacles, identifying available receptacles and/or identifying which components are plugged into which receptacles. This prevents the user from having to fumble around to get a better look at the receptacles, for instance by moving furniture or electronic equipment, or by moving the power strip 100 into a well-lit area.

It is possible for the continuous lighting member 112 to illuminate only when the on/off switch 108 is in the on position, or with a separate on/off switch provided solely for the member 112. More preferably, however, the member 112 remains on when the power strip 100 is plugged in to an active power source, whether or not the switch 108 is in the on or off position. Thus, it is possible that the member 112 is lit even though the receptacles 106 are not powered due to the switch 108 being off. This is advantageous because a power strip may be plugged into an outlet before the user's electronic equipment is hooked up. For instance, the user may position the power strip behind a couch in the user's home theater in advance of placing the home theater equipment in the room. Or the user may set up his or her home office in a certain manner, knowing where certain equipment will be placed. Then, when the user is ready to connect the equipment, he or she can easily locate the receptacles of the power strip without having to search for the power strip and pull it out from behind the couch, or behind a bookshelf, etc.

Figure 3A:
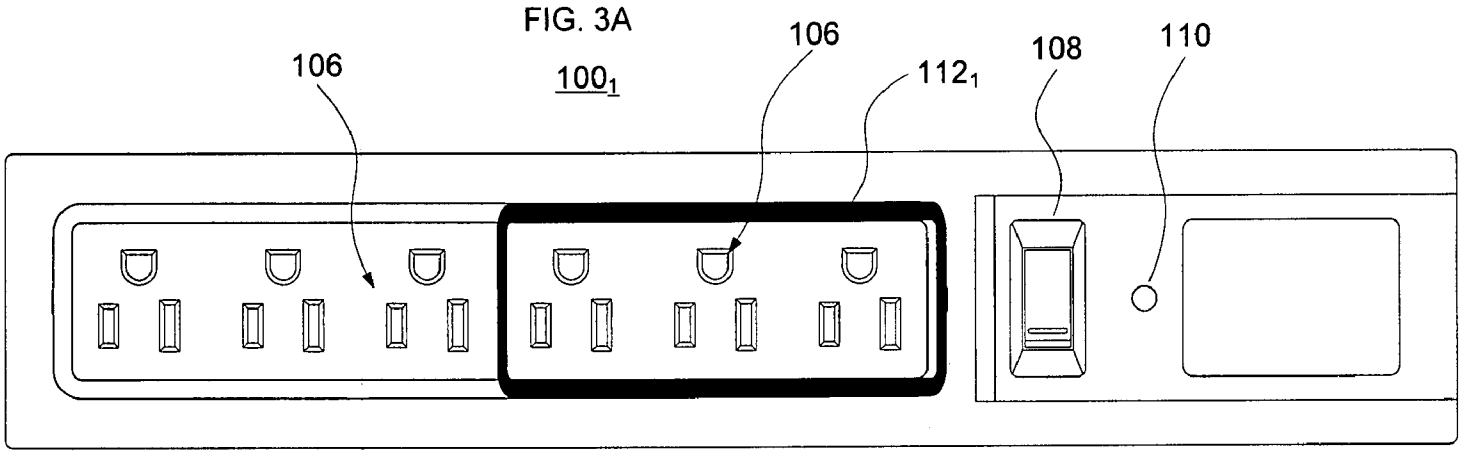
FIGS. 3A and 3B illustrate alternative power supply devices in accordance with aspects of the present invention.
Figure 3B:
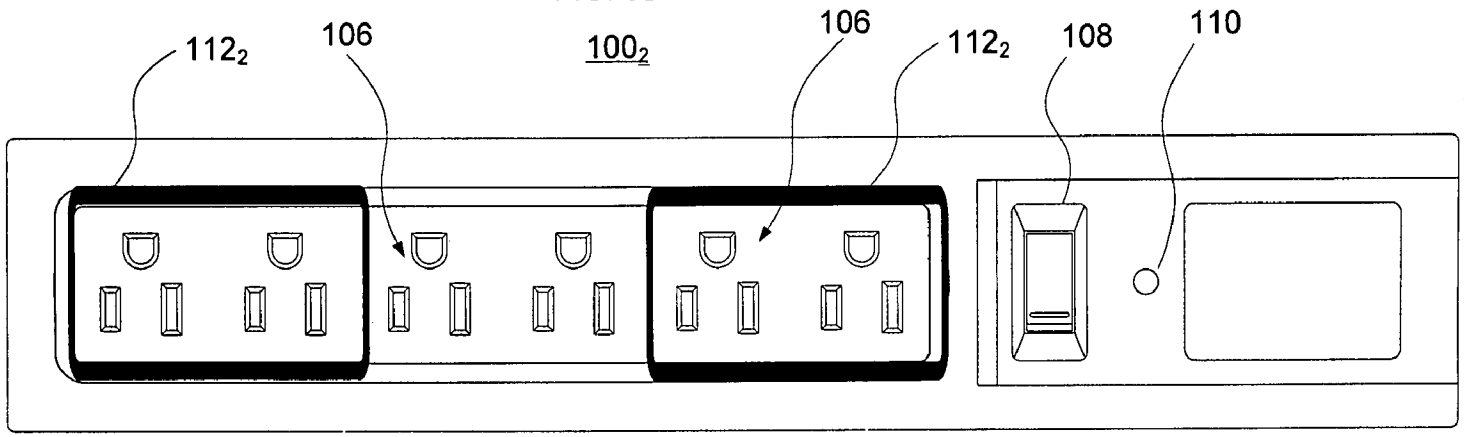

As discussed above, it is not necessary for the lighting member to encircle every single receptacle in a power strip. FIGS. 3A and 3B illustrate alternate examples of power strips $\mathbf{100}_1$ and $\mathbf{100}_2$ in which the lighting members $\mathbf{112}_1$ and $\mathbf{112}_2$, respectively, circumscribe only selected receptacles 106. The power strips $\mathbf{100}_1$ and $\mathbf{100}_2$ are similar to the power strip 100, with the exception that less than all of the receptacles 106 are surrounded by the lighting members. As seen in FIG. 3A, the lighting member $\mathbf{112}_1$ circumscribes only three of the six receptacles 106. And as seen in FIG. 3B, the pair of lighting members $\mathbf{112}_2$ circumscribe two different sets of receptacles 106. The lighting members $\mathbf{112}_1$ and $\mathbf{112}_2$ preferably utilize an electroluminescent material as described above with regard to the lighting member 112.

Regardless of the configuration of the lighting member(s), it is possible to select different colors for the lighting member(s). The electroluminescent material may be selected to have a particular color, such as red, green or blue. Here, the cover portion may be a clear material, such as a clear plastic. Alternatively the electroluminescent material may be selected to provide a white light. In this case, the cover portion may be chosen to have a particular color. The color(s) may be chosen to be decorative. However, it is more preferable to employ colored lighting for a more utilitarian reason, as will be explained below.

Manufacturers often offer power supply devices to have various levels of power surge protection. For instance, a given manufacturer may offer three different power supply devices that have three different levels of power surge protection, e.g., 400 Joules, 1200 Joules and 3200 Joules. These different devices may be used to protect different equipment. A user with a home theater system may want the highest Joule-rated power supply device to protect expensive electronic equipment, but may only want the lowest Joule-rated power supply device when using a telephone answering machine, cordless telephone system, or other inexpensive electronic components.

While it is possible to offer different Joule-rated models in different packages, once they are out of the box it may not be easy for the user to distinguish one model from another. In order to overcome this problem, according to the present invention different color schemes may be used with the lighting members in the different Joule-rated power supply devices. By way of example only, a 400 Joule device may have a green light, a 1200 Joule device may have a red light, and a 3200 Joule device may have a blue light. Of course, it should be understood that any color could be assigned to any of the different Joule-rated devices. In this manner, it is immediately apparent to the user what the Joule rating is based on the light color. And so if there are multiple power supply devices adjacent to one another, the user will be able to immediately visually distinguish which one has a given level of surge protection without having to find the instruction pamphlet. Optionally, certain receptacles in the power strip may have one Joule rating, while other receptacles in the same power strip may have another Joule rating. Here, the differently-rated receptacles may have lighting members of different colors.

Figure 4:
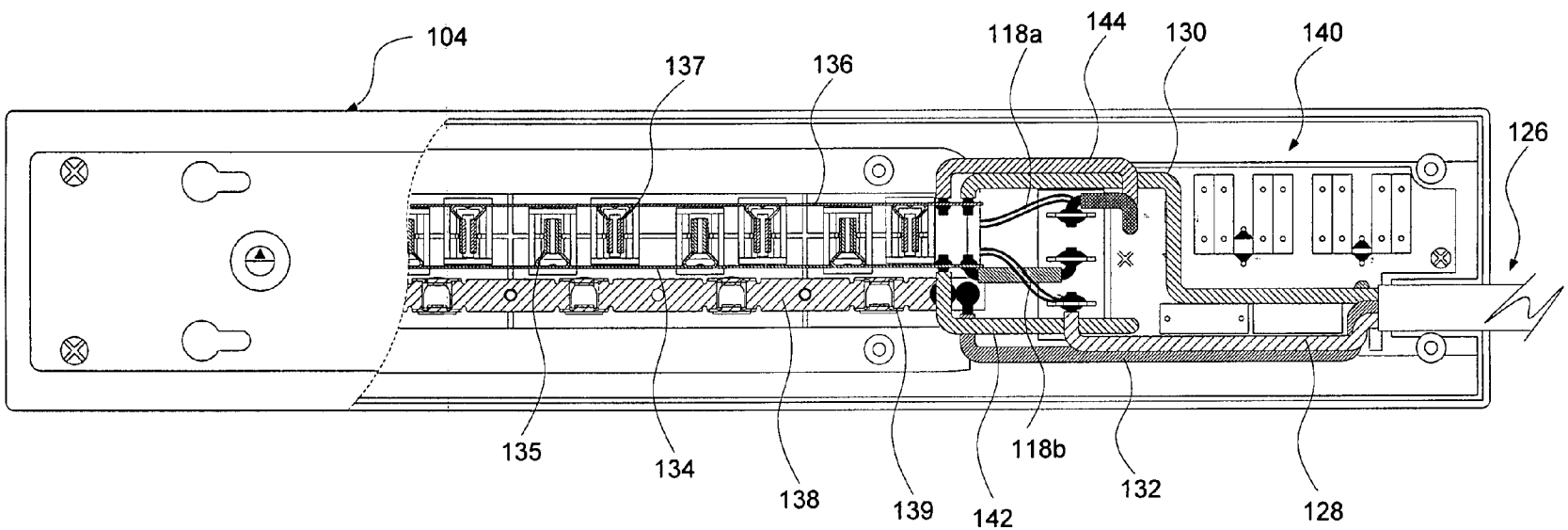
FIG. 4 is a partial cutaway view of the power supply device of FIGS. 1A-D.

Returning to the power strip 100, FIG. 4 is a partial cutaway view of the lower housing 104, showing the interior of the device. While omitted from FIG. 1D, power connector or cable 126 is shown in FIG. 4. Preferably, the power cable 126 is a three-wire cable including a "hot" lead or wire 128, a "neutral" lead or wire 130, and a "ground" lead or wire 132. In certain situations, the power strip may not provide grounded receptacles, and in such cases the ground wire 132 may be omitted.

A first power plate 134 is preferably electrically coupled to the hot wire 128, for example indirectly through the on/off switch 108. The first power plate 134 is electrically connected to the "hot" portions 135 of the receptacles 106. A second power plate 136 is preferably electrically connected to the neutral wire 130. The second power plate 136 is electrically connected to the "neutral" portions 137 of the receptacles 106. And a ground plate 138 is preferably electrically connected to the ground wire 132. The ground plate 138 preferably provides "ground" portions 139 of the receptacles 106.

The lead 118*a* of the illumination portion 114 is shown being electrically connected to the neutral wire 130, while the lead 118*b* is electrically connected to the hot wire 128. Thus, the illumination portion 114 will be lighted so long as the power cable 126 is connected to an active power source.

Also shown in FIG. 4 is a surge protection circuit 140, which is electrically coupled to the hot wire 128 and the neutral wire 130 through leads 142 and 144, respectively. The surge protection indicator 110 is preferably part of the surge protection circuit 140. The surge protection circuit 140 may be a conventional surge protection circuit as is known in the art. By way of example only, any of the surge protection circuits employed in the surge protection or power strip products from Trans USA Products, Inc. of 15 Lexington Avenue, East Brunswick, N.J., USA, are suitable for use as the surge protection circuit 140. These include, but are not limited to the surge protection circuits in Trans USA's "Pinnacle Surge Protectors—Silver and Gold Series."

Figure 5:
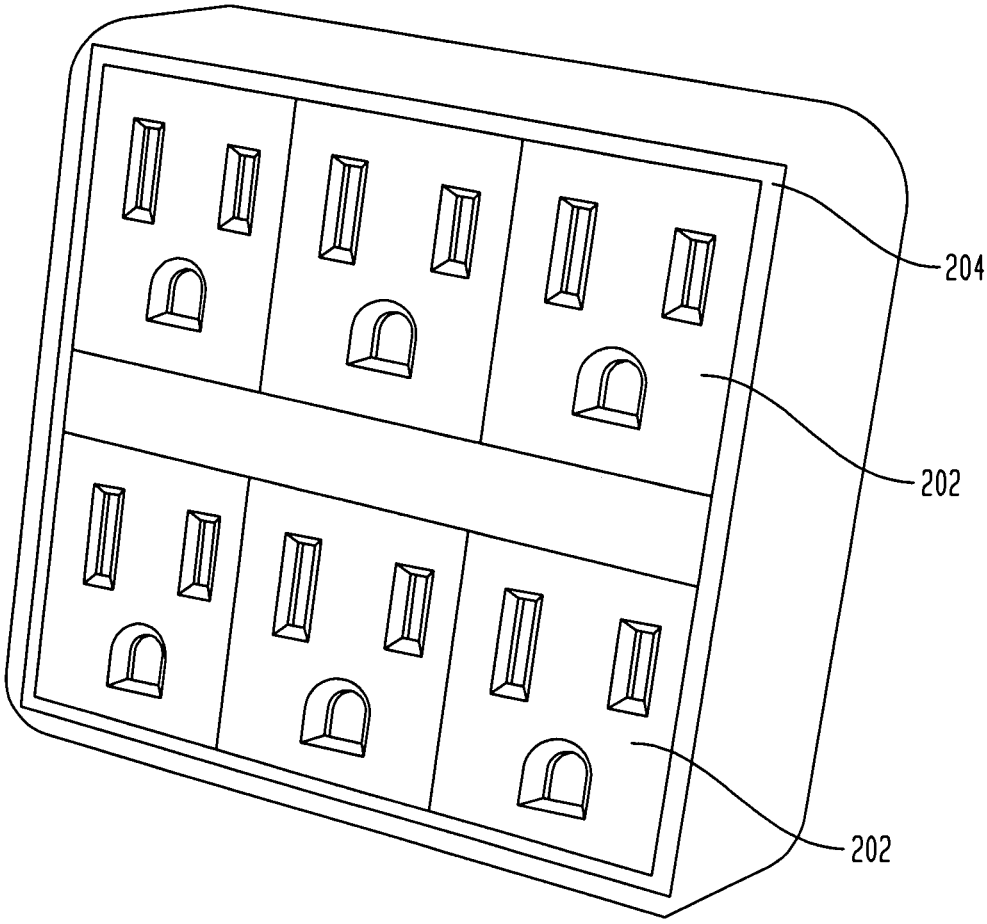
FIG. 5 illustrates a power tap in accordance with aspects of the present invention.

The present invention may be employed in all manner of power supply devices, and is not limited to use in power strips. For instance, FIG. 5 presents a power tap 200 in accordance with another aspect of the invention. The power tap 200 may be plugged into a conventional wall outlet (not shown) to provide additional receptacles. As shown in the figure, the power tap 200 includes six grounded receptacles 202 in a "three over three" configuration. The power tap 200 also includes a lighting member 204, which circumscribes all of the grounded receptacles 202. While the lighting member 204 may substantially circumscribe the receptacles 202, e.g., by circumscribing at least 75-90% of each receptacle 202, more preferably the lighting member 204 wholly circumscribes the each of the receptacles 202. The lighting member 204 is preferably of the same type of construction as the lighting member 112 described in detail above. For instance, the lighting member 204 preferably includes an illumination portion and a cover portion over the illumination portion. The illumination portion desirably comprises an electroluminescent material as described above. The color of the lighting member 112 may be varied, for instance depending upon the Joule rating of the power tap 200.

Figure 6:
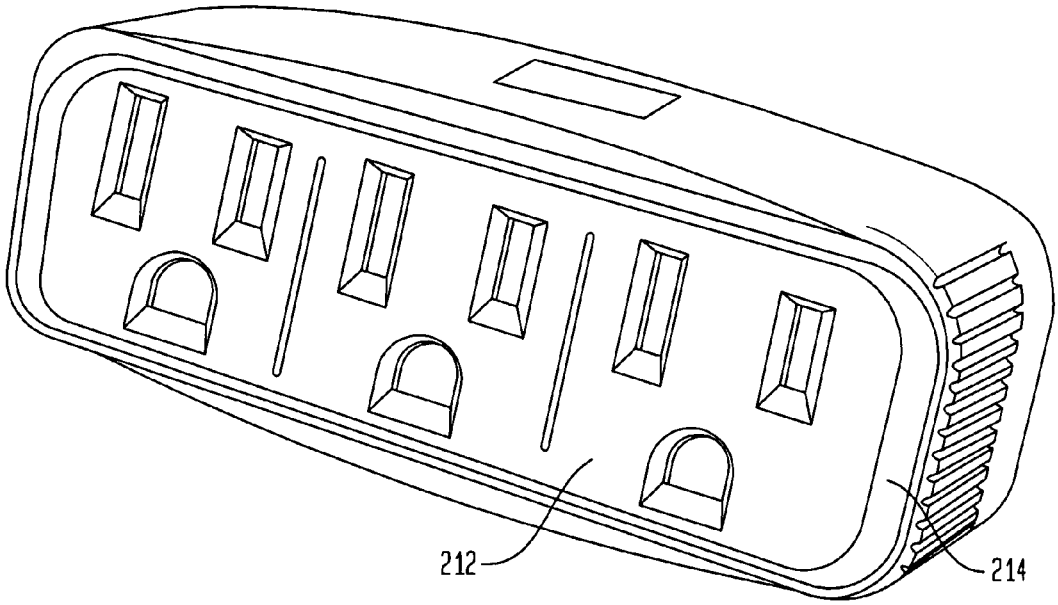
FIG. 6 illustrates another power tap in accordance with aspects of the present invention.

FIG. 6 illustrates another power tap 210, which includes a single row of three receptacles 212. Here, lighting member 214 preferably circumscribes all of the receptacles 212, either substantially or completely. Of course, it should be understood that the lighting members 204 and 214 may circumscribe one, some or all of the receptacles of the power taps, and each may be circumscribed substantially or completely.

Figure 7A:
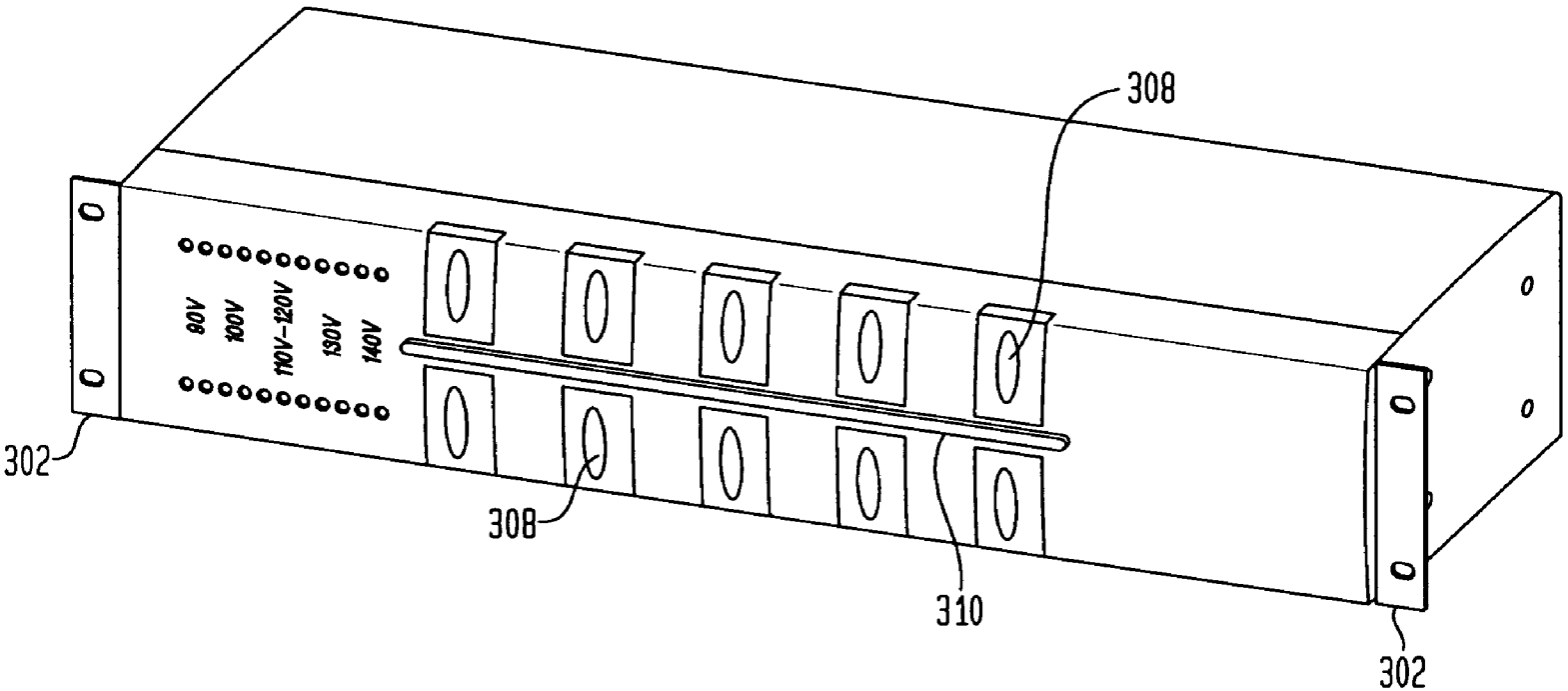
FIGS. 7A-B illustrate another power supply device in accordance with aspects of the present invention.
Figure 7B:
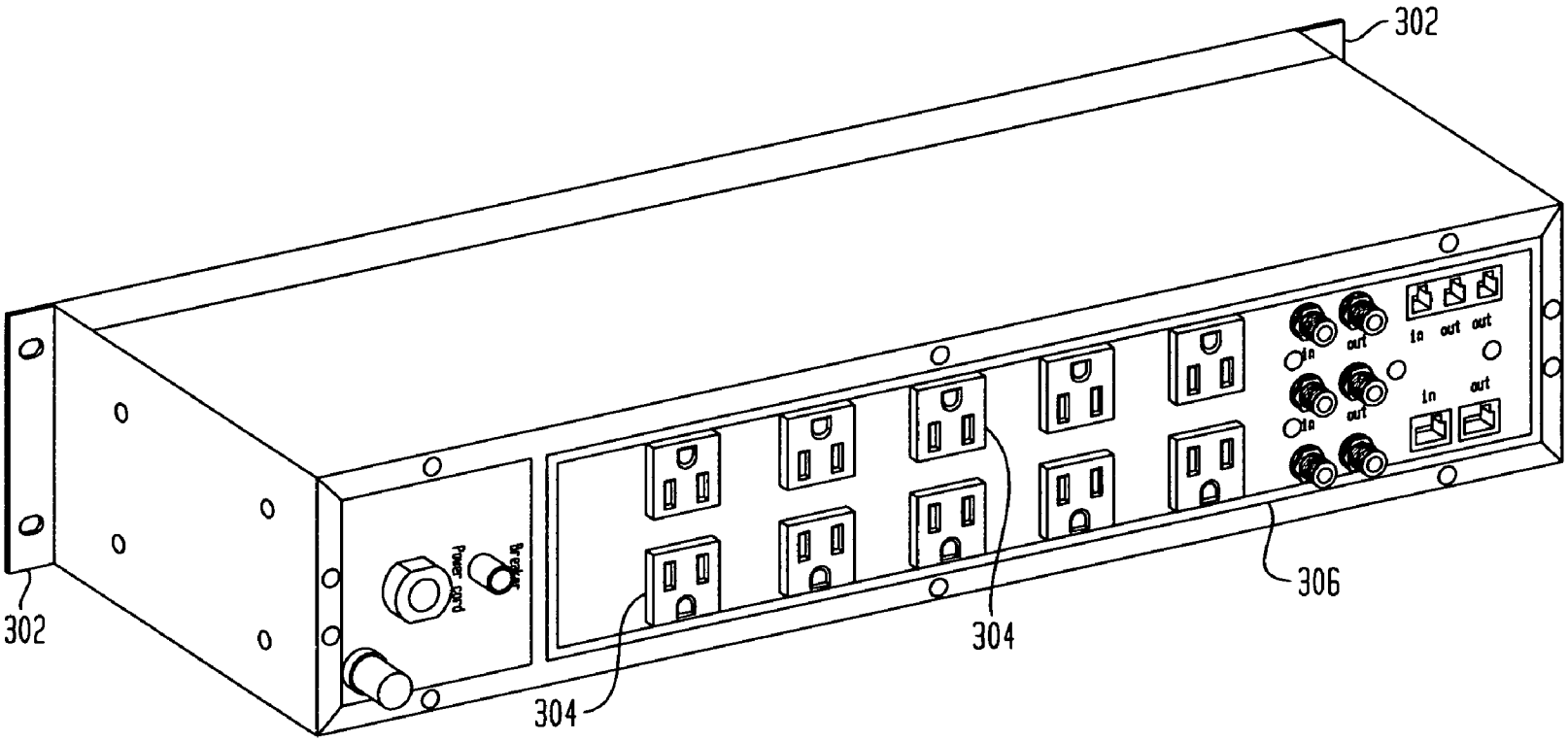

FIGS. 7A and 7B illustrate a power supply device 300 incorporating the present invention. As seen in the front view of FIG. 7A and the rear view of FIG. 7B, the power supply device 300 is particularly adapted for rack mounting, and includes flanges 302 for securing the device 300 to a rack system (not shown). Such a device may be used, by way of example only, in a high-end rack mounted home entertainment system.

The rear view of FIG. 7B shows that the device 300 may include 10 receptacles 304, although any number of receptacles 304 may be employed. Here, lighting member 306 circumscribes all of the receptacles 304, although as discussed above it is possible for the lighting member 306 to circumscribe less than all of the lighting members. The lighting member 306 is preferably of the same configuration as the lighting member 112 described above, and desirably includes an electroluminescent light source. As shown in FIG. 7A, the front panel of the power supply device 300 may include a series of on/off buttons or switches 308 to power respective ones of the receptacles 304 on or off. The buttons 308 may include lights therein.

The front panel may also include a lighting member 310. As shown, the lighting member 310 may be disposed between two rows of the buttons 308. Alternatively, the lighting member 310 may circumscribe some or all of the buttons 308. Preferably, the lighting member 310 includes an electroluminescent light source.

Thus it can be seen that the present invention may be employed with all different types of power supply devices. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. For instance, the lighting members in the various embodiments may circumscribe some or all of the power receptacles, either substantially or completely. Different color schemes may be used to identify different levels of surge protection in any of the embodiments. Thus, the present invention offers users a means to clearly illuminate available receptacles or to show which plugs are connected to which receptacles. The present invention also enables the user to immediately identify the surge protection rating of the power supply device.

The invention claimed is:

1. A power supply device, comprising:

a housing member having a side including an on/off switch in a first region thereof and a plurality of receptacles adapted for electrical connection to external electronic equipment, the plurality of receptacles being disposed in a second region of the side of the housing member;

a power connector operable to electrically couple to a power source, the power connector having a hot lead, a neutral lead and a ground lead;

a first power plate electrically coupled to the hot lead of the power connector and operable to provide a hot connection to the plurality of receptacles;

a second power plate electrically coupled to the neutral lead of the power connector and operable to provide a neutral connection to the plurality of receptacles;

a ground plate electrically coupled to the ground lead and operable to provide a ground connection to the plurality of receptacles; and a lighting member disposed along a third region of the side of the housing member, the third region circumscribing at least one of the plurality of receptacles, the lighting member being electrically coupled to the hot and neutral leads of the power connector, wherein the lighting member is operable to illumination the at least one receptacle.

2. The power supply device of claim 1, wherein the lighting member includes a first lead directly electrically connected to the hot lead, and a second lead directly electrically connected to the neutral lead so that the lighting member is illuminating while the power connector is electrically coupled to the power source.

3. The power supply of claim 1, wherein the lighting member includes an illumination portion of an electroluminescent material.

4. The power supply of claim 3, wherein the electroluminescent material is a single continuous sheet of material.

5. The power supply of claim 3, wherein the lighting member further comprises a cover portion on the side of the housing, the cover portion overlaying the electroluminescent material.

6. The power supply of claim 5, wherein the power supply device further includes a surge protection device electrically coupled to the first and second power plates, and wherein at least one of the electroluminescent material and the cover is selected to have a color identifying a surge protection rating associated with the power supply.

7. The power supply of claim 1, wherein the lighting member completely circumscribes all of the receptacles.

8. The power supply of claim 1, wherein the lighting member substantially encircles selected ones of the receptacles.

9. The power supply of claim 1, wherein the power supply is a power strip and the power connector includes cabling for electrically coupling to the power source.

10. The power strip of claim 1, wherein the power supply is a power tap.

11. A power supply device, comprising:

a housing member including an on/off switch to turn power to the power supply device on and off and a plurality of receptacles disposed along a first region thereof, the receptacles being adapted for electrical connection to external electronic equipment;

a power connector operable to electrically couple to a power source, the power connector having a hot lead and a neutral lead;

a first power plate electrically coupled to the hot lead of the power connector and operable to provide a hot connection to the plurality of receptacles;

a second power plate electrically coupled to the neutral lead of the power connector and operable to provide a neutral connection to the plurality of receptacles; and lighting means circumscribing the plurality of receptacles along the first region of the housing member, wherein the lighting means is operable to illuminate all of the receptacles.

12. The power supply of claim 11, wherein the lighting means completely circumscribes all of the receptacles.

13. The power supply of claim 11, wherein the lighting means substantially encircles selected ones of the receptacles.

14. The power supply of claim 11, wherein the lighting means comprises an electroluminescent laminate having a first lead electrically coupled to the hot lead and a second lead electrically coupled to the neutral lead.

15. The power supply of claim 14, wherein the first and second leads are electrically connected so that the electroluminescent laminate continuously illuminates while the power connector is electrically coupled to the power source.

16. The power supply of claim 14, further comprising a lighting switch connected to the first and second leads so that a user may manually turn illumination of the electroluminescent laminate on or off.

17. The power supply of claim 11, wherein the lighting means provides a color identification associated with a surge protection rating of the power supply.

18. The power supply of claim 11, wherein the housing member is a rack mountable housing and includes a pair of flanges for mounting the power supply to an electronic equipment rack.

* * * * *

UNITED STATES PATENT AND TRADEMARK OFFICE

CERTIFICATE OF CORRECTION

PATENT NO. : 7,402,060 B1
APPLICATION NO. : 11/650864
DATED : July 22, 2008
INVENTOR(S) : Elliot Buzil, Andrew Hung and Ken Ku It is certified that error appears in the above-identified patent and that said Letters Patent is hereby corrected as shown below:

Cover page, item (73) Assignee: "Highstown" should read -- Hightstown --.

Signed and Sealed this

Twentieth Day of October, 2009

David J. Kappos

David J. Kappos
*Director of the United States Patent and Trademark Office*